US006899133B2

(12) United States Patent
Brunkhardt

(10) Patent No.: US 6,899,133 B2
(45) Date of Patent: May 31, 2005

(54) TIMED SHOWER VALVE MANAGER

(76) Inventor: Donald D. Brunkhardt, 2942 S. Trenton St., Denver, CO (US) 80231

( * ) Notice: Subject to any disclaimer, the term of this patent is extended or adjusted under 35 U.S.C. 154(b) by 13 days.

(21) Appl. No.: 10/863,890

(22) Filed: Jun. 8, 2004

(65) Prior Publication Data

US 2005/0016603 A1 Jan. 27, 2005

Related U.S. Application Data

(60) Provisional application No. 60/476,637, filed on Jun. 9, 2003.

(51) Int. Cl.[7] ..... G06F 15/46

(52) U.S. Cl. ..... 137/624.11; 251/30.02; 239/69

(58) Field of Search ..... 137/624.11, 624.13, 137/624.15, 552.7; 251/30.02; 239/69

(56) References Cited

U.S. PATENT DOCUMENTS 5,121,511 A * 6/1992 Sakamoto et al. ..... 251/30.02
5,699,833 A * 12/1997 Tsataros ..... 137/624.11
6,016,836 A * 1/2000 Brunkhardt ..... 137/624.11
6,547,211 B2 * 4/2003 Roman ..... 251/30.01

* cited by examiner

*Primary Examiner*—Kevin Lee

(57) ABSTRACT

An automated externally mounted shower timer and flow control device powered by a low voltage battery.

9 Claims, 2 Drawing Sheets

TIMED SHOWER VALVE MANAGER

CROSS REFERENCED TO RELATED APPLICATIONS

This application is related to application Ser. No. 132,853, filed Aug. 11, 1998, now U.S. Pat. No. 6,016,836, granted Jan. 25, 2000 filed by the present inventor.

This application claims the benefit of Provisional patent application No. 60/476,637 filed Jun. 9, 2003 filed by the present inventor.

BACKGROUND OF INVENTION

1. Field of Invention

This invention relates to the controlling of showering times and to limiting shower water usage.

2. Background of Invention

Any parent who has teenagers can attest to the need of restricting the amount of time and water teenagers' use while taking showers. It is not uncommon for nerves to be worn thin when a family member is using the shower while others wait. In other instances, kids are late for school or appointments because their "quick shower" turned into an "extended shower." Not to mention the cold water showers if you happen to be last in line.

Another problem of extended showers is the wasting of water and the energy used to process it and heat it. In many parts of the country and the world for that matter, water is a scarce and expensive commodity with water officials seeking more and better ways to conserve water. Prior art has made some strides in this direction, but there seems to be a lack of enthusiasm for many of these devices. Devices that just restrict the flow of water lack popularity especially with women as a conservation flow does little to thoroughly rise a Shower Manager head of hair. Devices that shut off water flow after a predetermined period of time or volume of water often frustrate users because of the abrupt cessation of water flow. Other devices require control or set up every time they are used and can be easily overridden or manipulated. Let's face it, many bathers and especially responsible adults believe in the spirit of conservation efforts but don't easily embrace devices that limit the enjoyment, the stimulation and the cleansing affect a shower brings.

OBJECTS AND ADVANTAGES

While no shower device satisfies every consideration, the intent of the Shower Manager is to give the bather a taste of both worlds. That is, an initial period of time wherein the bather can enjoy a full flow or unrestricted flow of water and a subsequent conservation flow or restricted flow of water if the bather does not finish within the full flow cycle. The objective of this conservation flow is to hasten the completion of the shower as a limited flow of water through the showerhead provides less stimulation and enjoyment as that of a full flow of water. Additionally, the conservation flow of water inherently uses less water than that consumed during full flow. Other goals of the Shower Manager are to provide a device that is affordable, easy to install, and provide for hands free operation. This device also needs to be inexpensive to operate and not easily overridden. Another objective would be for the unit to be safe and would not interfere with normal shower on/off controls including the mixture of hot and cold water. Cost recover of this device through savings in water and energy charges are also a must. To meet today's diversity of cultures the unit should also provide for various full flow time settings. These features, as well as others, are more fully described herein below. Further objects and advantages of my invention will become apparent from a consideration of the drawings and ensuing description.

SUMMARY

An automated programmable shower flow control device used to control showering times and to control the amount of water used while showering.

DRAWINGS

DETAILED DESCRIPTION

Figure 1:
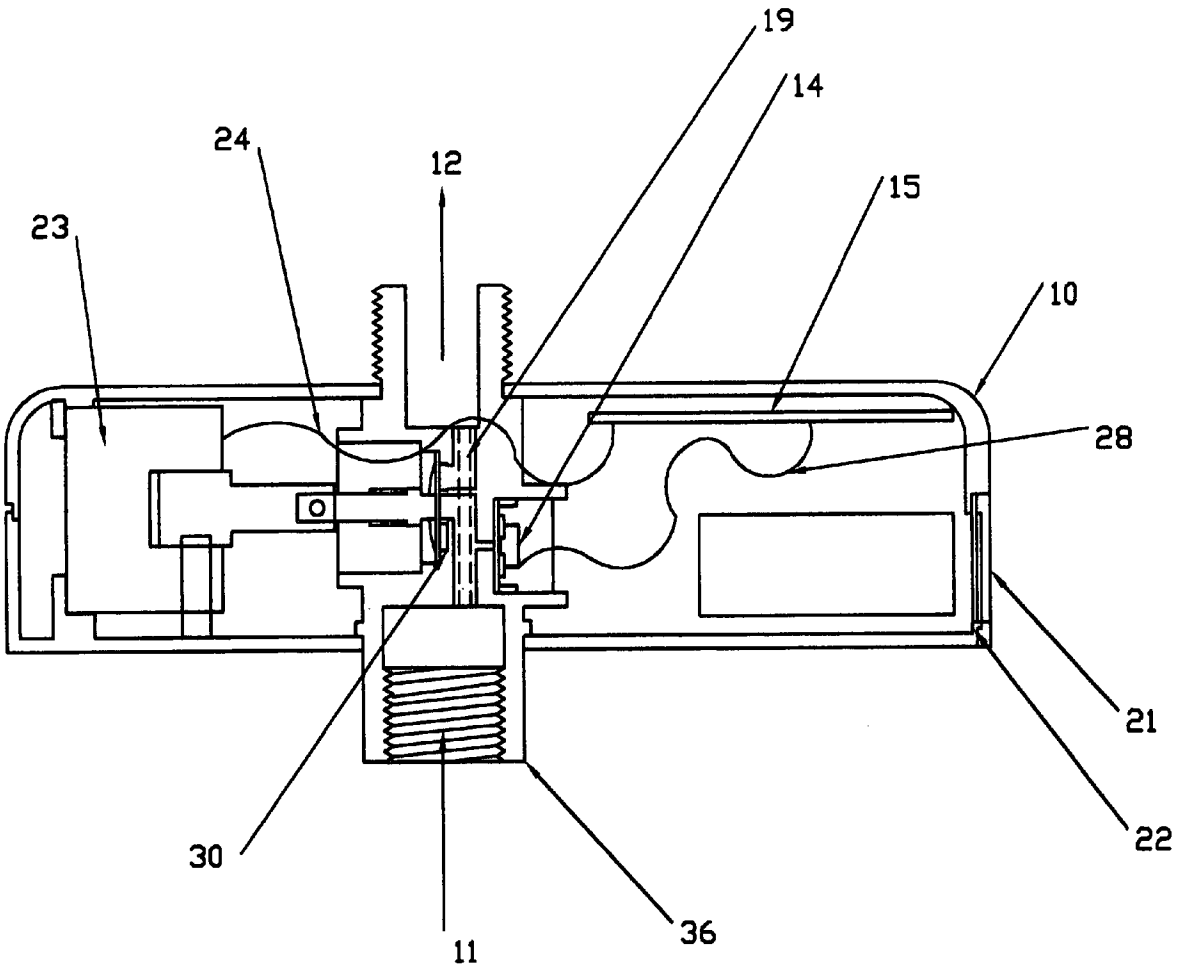
FIG. 1 shows a cross-sectional view of the housing showing the flow tube, flow in connection, flow out connection, inlet channel, outlet channel, flow sensor switch, latching solenoid, solenoid wires, control board, sensor wires, battery cover, battery wires, battery compartment, battery cover seal, and latching solenoid in the closed position.
Figure 2:
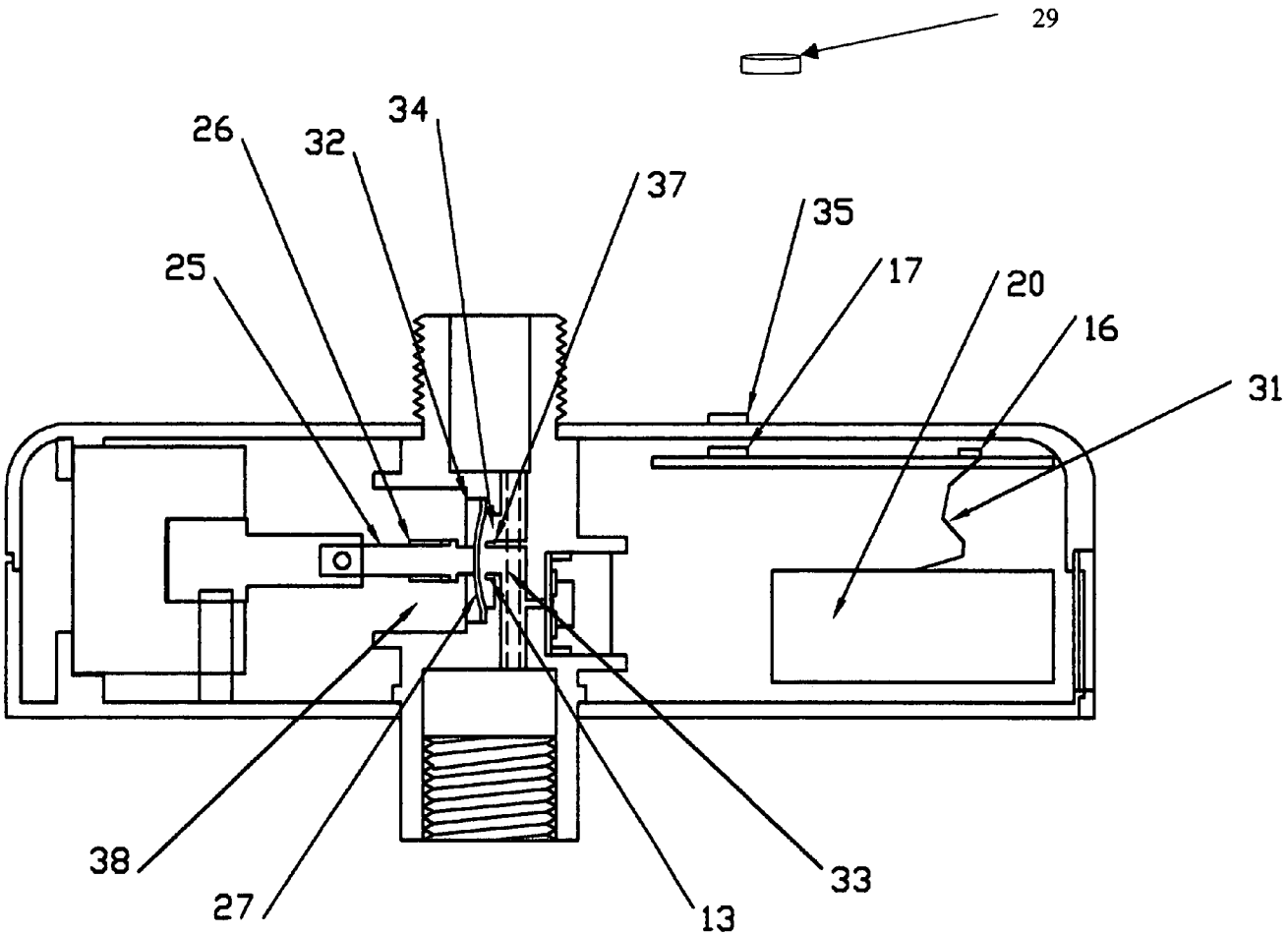
FIG. 2 shows a cross-sectional view of the housing showing the piston, spring, diaphragm seal, diaphragm seal plug, bypass channel housing, central processing unit (CPU), bypass channel, magnetic sensor marking, alarm, magnet, magnetic sensor, bypass inlet port, bypass outlet port, channel divider, and the latching solenoid in the open position.

The Shower Manager is a water control system placed between a water supply pipe and a showerhead mechanism. In FIGS. 1 and 2 the main components of this water saving device are a housing 10 which contains the following components: a flow in connection 11; a flow out connection 12; a bypass channel 13; a flow sensor switch 14; a central processing unit (CPU) 15; an alarm 16; a magnetic sensor 17; an inlet channel 18; an outlet channel 19; a battery compartment 20; a battery cover 21; a battery cover seal 22; a latching solenoid 23; a solenoid wires 24; a piston 25; a spring 26; a diaphragm seal 27; a sensor wires 28; a magnet 29; by pass channel housing 30; battery wires 31; a diaphragm washer 32; bypass inlet port 33; bypass outlet port 34; a magnetic sensor marking 35; a flow tube 36; a channel divider 37; and a diaphragm seal plug 38.

The flow tube 36 is standard size for normal household shower plumbing connections with the flow in connection 11 being female threaded and the flow out connection 12 being male threaded. The flow sensor switch 14 located in the inlet channel 18 is connected through the sensor wires 28 to the CPU 15. Located in the bypass channel 13 is the bypass inlet port 33 and the bypass outlet port 34; covering the bypass channel 13 and forming a watertight seal is the diaphragm seal 27. The channel divider 37 separates the bypass channel 13 from the outlet channel 19. The diaphragm seal 27 is held in place by the outer rim of the domed shaped diaphragm washer 32 which, in turn, is attached to the bypass channel housing 30 by the diaphragm seal plug 38. One end of the piston 25 goes through a cylindrical opening in the center of the diaphragm seal plug 38 and the diaphragm washer 32 and bears on the diaphragm seal 27. The other end of the piston 25 engages the latching solenoid 23. The spring 26 wraps the piston. The piston 25 is actuated by the latching solenoid 23. The latching solenoid 23 is connected to the CPU 15 by the solenoid wires 24. Located within the housing 10 is the CPU 15; contained within the CPU 15 is the alarm 16; the magnetic sensor 17 and logic and timing circuits (not shown). The CPU 15 is energized through the battery wires 31 connected to a low voltage dry cell battery (not shown) located in the battery compartment 20. The battery cover 21 encloses the battery compartment 20 with the battery cover seal 22 providing a watertight seal. The magnetic sensor marking 35 is located on the outside of the housing directly above the magnetic sensor 17 located on the CPU 15.

Operation

At the time of installation of the Shower Manager the installer chooses a full flow water time setting that suits the lifestyle of the users, lets say 5 minutes. The full flow time setting is set using a magnet 29 that is placed up close to the magnetic sensor marking 35 located on the exterior of the housing 10. The magnet 29 activates the magnetic sensor 17, which activates the alarm 16 on the CPU 15. A series of beeps from the alarm 16 coincides with a full flow time frame, i.e., 1 beep 5 minutes, 2 beeps 8 minutes, etc. The full flow time frames can be changed subsequent to installation using the magnet 29.

With the Shower Manager, a bather starts showering by turning on the water control valve commonly located on the shower/tub wall. Water enters the flow in connection 11 and flows through the inlet channel 18 and through the outlet channel 19 and exits through the flow out connection 12. As water volume builds in the inlet channel 18, water pressure closes the flow sensor switch 14, which, in turn signals, through the sensory wires 28, the CPU 15. The CPU 15, in turn, sends an electrical current, through the solenoid wires 24, to the latching solenoid 23. The electrical current sent to the latching solenoid 23 is momentary in nature, just long enough to create a magnetic filed that retracts the piston 25. As the piston 25 retracts, pressure on the diaphragm seal 27, held in place by the outer rim of the diaphragm washer 32, eases permitting the diaphragm seal 27 to expand within the domed cavity of the diaphragm washer 32. This expansion permits water to circulate up through the bypass inlet port 33 and out through the bypass outlet port 34 to the outlet channel 19. As the bypass channel 13 opens, the main cycle timer starts on the CPU 15 timing the full flow water interval that was preset prior to showering or at the time of installation. FIG. 2.

Approximately 60 seconds prior to the end of the full flow time frame, the CPU 15 sends a signal to the alarm 16 to provide an audible beep. This beep provides the bather advance notice that the unit will soon advance to conversation mode. As the full flow time frame expires, the CPU sends an electrical signal to the latching solenoid 23 through solenoid wires 24. This time, however, the electric current sent to the latching solenoid 23 is sent in the opposite direction thus repelling the piston 25. The repelling force of the piston 25 aided by the force of the spring 26 now bears upon the diaphragm seal 27 which in turn seals off the bypass inlet port 33 and the bypass outlet port 34 thus closing the flow of water through the bypass channel 13. The amount of water now flowing out the flow out connection 12 is approximately 50% of that when the bypass channel 13 was open. The Shower Manager with water flowing only through the inlet channel 18 to the outlet channel 19 is now in conservation mode. FIG. 1.

This conservation flow allows the bather to continue to bath, rinse off, etc., but under less than desirable conditions. The objective would be for the bather to bring the shower to a hasty close, as the reduced volume of water would be less stimulating and not as enjoyable as a full flow of water. Also, bathing during conservation flow uses considerably less water.

When the bather finishes showering, regardless of the interval, the Shower Manger must go through a reset interval (say, 5 minutes) before full flow water can be achieved again. As the bather turns off the main supply valve, the diminished water pressure in the inlet channel 18 opens the flow sensor switch 14. The flow sensor switch 14 then signals, through sensor wires 28, the CPU 16 to begin the reset timer. During the reset interval the CPU 15 prevents an electrical current from being sent to the latching solenoid 23 through solenoid wires 24. After the reset interval has expired, the Shower Manager can again be operated with a full flow water delivery.

An important safety feature inherent in the operation of this unit is that the Shower Manager does not function as the main on/off water value for the shower unit. Control of this important function, as well as the mixture of hot/cold water, remains with the main shower valve. Also, the low voltage DC battery minimizes any electrical shock or hazard. When the battery runs low, the unit stays in the conservation flow mode until the battery is replaced. No special controls or settings are needed to activate or use the Shower Manager during normal use. Controls and settings are preset at the time of installation giving the unit a fully automated operation.

Conclusion, Ramification and Scope

The reader will see that the Shower Manager is a practical, safe and economical alternative to the prior art and appeases the agendas of conservationists, individuals, parents, etc. It is anticipated that water departments, city councils, etc. will embrace this concept.

While the Shower Manager has been described with reference to particular embodiments, it is not intended to illustrate or describe all of the equivalent forms or ramifications. Also, the words used are words of description rather than limitation and various changes may be made without departing from the spirit or scope of the Shower Manager.

I claim:

1. A programmable water flow control showering valve device comprising:

a) a housing b) a connection for the inlet of water from a water source;

c) an inlet channel that contains a switch that activates when water enters the channel;

d) a channel divider that divides the flow between the inlet channel and a bypass channel;

e) a diaphragm seal that covers the bypass channel that provides for a watertight seal;

f) a latching solenoid through means of a piston that opens and closes the bypass channel;

g) an outlet channel and a flow out connection;

h) a CPU is contained within the housing and contains logic circuits, timers, an alarm, and a magnetic sensor; and i) a battery compartment is accessible from the external housing.

2. The invention defined in claim 1 wherein a first timer means activates signal producing means a predetermined time before closing of a valve.

3. The invention defined in claim 2 wherein the inlet channel is of such a size to substantially reduce the flow of water through the device when said valve device is closed.

4. The invention defined in claim 2 wherein a timer prevents said valve from reopening before a predetermined time interval has expired.

5. The invention defined in claim 4 wherein an interval of time said valve remains open is predetermined.

6. The invention defined in claim 5 wherein a notification time interval, by the alarm sounding, that said valve would close is predetermined.

7. The invention defined in claim 1 wherein the solenoid does not require constant electrical charge to remain open.

8. The invention defined in claim 5 wherein said intervals are determined after placing a magnetic device next to the magnetic sensor and establishing said intervals using audible tones.

9. The invention defined in claim 1 wherein said valve device could be powered by a low voltage power source.

* * * * *